US007806248B2

(12) United States Patent
Hunter et al.

(10) Patent No.: US 7,806,248 B2
(45) Date of Patent: Oct. 5, 2010

(54) SYSTEM AND METHOD FOR COIN VALIDATION

(75) Inventors: Stephen John Hunter, Randpark Extension 4 (ZA); Andre Malan Joubert, Edenvale (ZA)

(73) Assignee: IPS Group, Inc., Rancho Santa Fe, CA (US)

( * ) Notice: Subject to any disclaimer, the term of this patent is extended or adjusted under 35 U.S.C. 154(b) by 76 days.

(21) Appl. No.: 12/056,191

(22) Filed: Mar. 26, 2008

(65) Prior Publication Data

US 2009/0032368 A1 Feb. 5, 2009

Related U.S. Application Data

(60) Provisional application No. 60/908,109, filed on Mar. 26, 2007.

(51) Int. Cl.
*G07D 5/08* (2006.01)

(52) U.S. Cl. ..... 194/317; 194/319

(58) Field of Classification Search ..... 194/317, 194/319

See application file for complete search history.

(56) References Cited

U.S. PATENT DOCUMENTS 5,244,070 A 9/1993 Carmen et al.
5,273,151 A 12/1993 Carmen et al.
5,360,095 A * 11/1994 Speas ..... 194/217
5,806,651 A 9/1998 Carmen et al.
5,833,042 A * 11/1998 Baitch et al. ..... 194/317
2003/0121754 A1 * 7/2003 King ..... 194/302
2004/0084278 A1 * 5/2004 Harris et al. ..... 194/302

* cited by examiner

*Primary Examiner*—John Q. Nguyen
*Assistant Examiner*—Mark Beauchaine
(74) *Attorney, Agent, or Firm*—Townsend and Townsend and Crew LLP

(57) ABSTRACT

A system for validating a coin has a passageway through which the coin passes, in use; an oscillator having a component positioned relative to the passageway for the frequency and amplitude of oscillation of the oscillator to be varied, in use, by passage of the coin along the passageway; a period (or frequency) determining unit for determining the period (or frequency) of an oscillating signal provided by the oscillator when influenced by the coin and for supplying a determined period (or frequency) value; an amplitude determining unit for determining the amplitude of the oscillating signal provided by the oscillator when influenced by the coin and for supplying a determined amplitude value; and an assessing unit for assessing if the determined period (or frequency) and amplitude values lie in a predetermined window of period (or frequency) and amplitude values.

28 Claims, 2 Drawing Sheets

SYSTEM AND METHOD FOR COIN VALIDATION

This application claims the benefit of U.S. Provisional Application No. 60/908,109, filed Mar. 26, 2007, by Hunter et al., entitled SYSTEM AND METHOD FOR COIN VALIDATION, which is incorporated in its entirety herein by reference.

FIELD OF THE INVENTION

THIS INVENTION relates to a system and a method for validating a coin. More particularly, but not exclusively, this invention relates to a system and a method for validating coins that are suitable for use in a parking meter.

SUMMARY OF THE INVENTION

According to the invention there is provided a system for validating a coin, the system including a passageway through which the coin passes, in use;

an oscillator having a component positioned relative to the passageway for the frequency and amplitude of oscillation of the oscillator to be varied, in use, by passage of the coin along the passageway;

a time feature determining unit for determining a time feature of an oscillating signal provided by the oscillator when influenced by the coin and for supplying a determined time feature value;

an amplitude determining unit for determining the amplitude of the oscillating signal provided by the oscillator when influenced by the coin and for supplying a determined amplitude value; and an assessing unit for assessing if the determined time feature and amplitude values lie in a predetermined window of time feature and amplitude values.

Further according to the invention there is provided a method of validating a coin in a coin-operated machine having a coin passageway, the method including the steps of:

providing an oscillator, having a component positioned relative to the passageway for the frequency and amplitude of oscillation of the oscillator to be varied, in use, by passage of the coin along the passageway;

determining a time feature of oscillation of an oscillating signal provided by the oscillator when a coin to be validated influences the oscillator;

determining the amplitude of the oscillating signal; and assessing if the determined time feature and amplitude values lie in a predetermined window of time feature and amplitude values.

In one embodiment the time feature is conveniently the period of oscillation of the oscillating signal. Those skilled in the art will readily appreciate that it could be the frequency of oscillation.

In one embodiment, the window of time feature and amplitude values are defined by straight lines and in a further variation, the straight lines are substantially rectangular. In another embodiment, the window is further angled with respect to time feature and amplitude axes.

In some embodiments, whether the determined time feature and amplitude values lie in the predetermined window of time feature and amplitude values are assessed by computing test time feature and amplitude values from the determined time feature and amplitude values utilising linear and rotational transformations, and comparing the test amplitude value with a predetermined amplitude validation value and the test time feature value with a predetermined time feature validation value. Thus, these embodiments of the system include a computing device for computing test time feature and amplitude values from the determined time feature and amplitude values utilising linear and rotational transformations, and a comparator for comparing the test time feature and amplitude values with predetermined time feature and amplitude validation values, respectively. It will be appreciated that in one embodiment, the assessment then includes checking if the test amplitude and time feature values lie in a rectangular window.

Those skilled in the art will further appreciate that in some embodiments, the computing device may use predetermined multiplying and addition coefficients. In one embodiment, these coefficients include the cosine and sine values of the angle defined by a straight line aligned with the window and its intersection value with the ordinate axis.

In one embodiment, an amplitude validation value, a time feature validation value and the various coefficients are predetermined for each coin denomination. It will then be appreciated that according to this embodiment, a particular coin is validated and is allocated the value of a particular denomination, if the test time feature and amplitude values computed for the coin are between zero and the validation time feature and amplitude values for that denomination.

It will thus be appreciated by those skilled in the art that the several embodiments of the invention encompass the use of transformations to provide a validation window positioned at the origin of a time feature v amplitude graph.

In some embodiments, the oscillator has a coil, which surrounds the passageway.

In some embodiments, the coefficients and the validation values are determined by calibrating a suitable number of coins of each denomination.

In one embodiment, the system includes a plurality of oscillators, each having a coil that surrounds the passageway. The time feature and amplitude of the oscillating signals resulting when a coin being validated passes through each coil are determined, and these determined signals are then processed by the assessing means. The coin may then be validated and allocated the relevant denomination value if the computed values from both oscillators provide the same denomination value or if only one oscillator provides a denomination value.

Several embodiments of the invention accordingly extend further to the use of a plurality of oscillators to validate a coin.

BRIEF DESCRIPTION OF THE DRAWINGS

Embodiments of the invention are now described, by way of example only and without limiting the scope of the invention, with reference to the accompanying figures, wherein.

DETAILED DESCRIPTION

Figure 1:
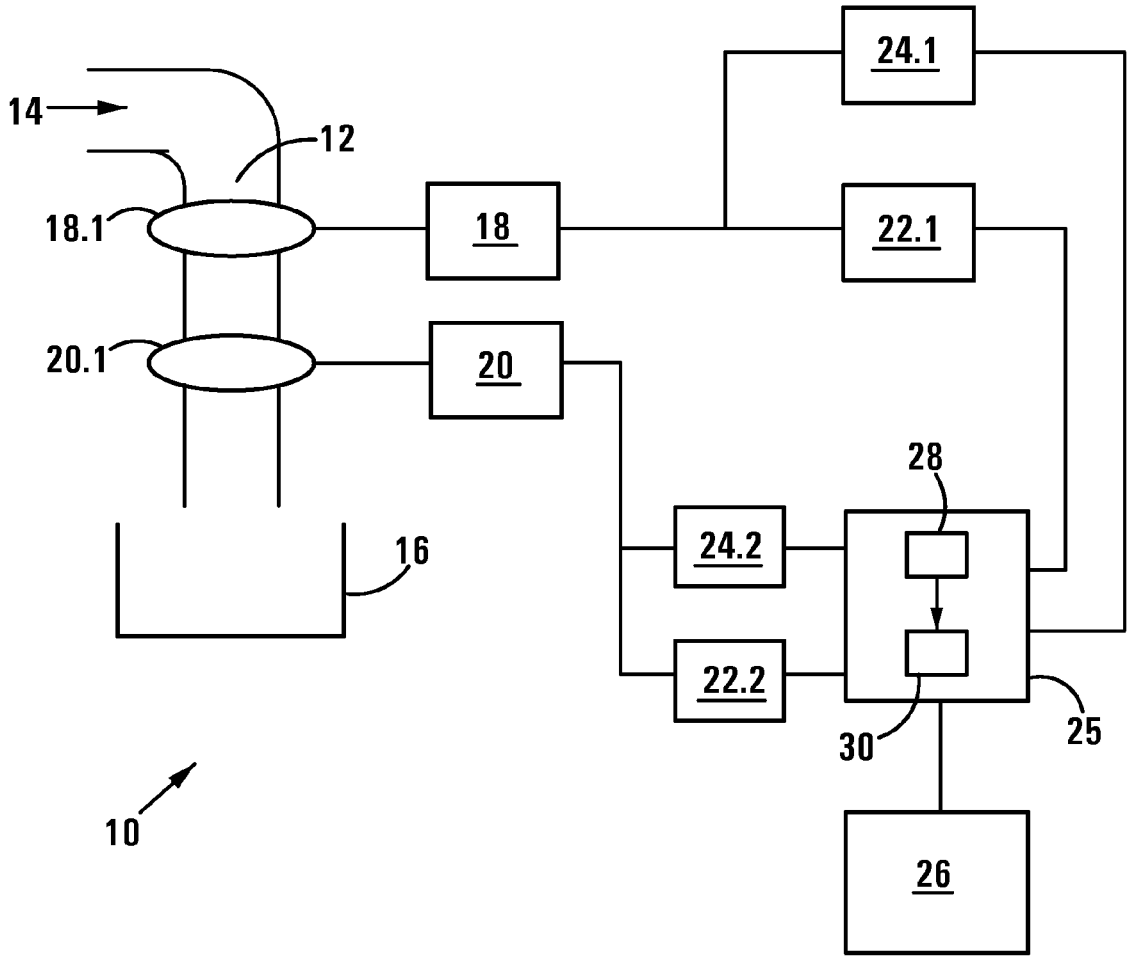
FIG. 1 shows schematically a coin validation system in accordance with one embodiment of the invention.

Referring to FIG. 1, a coin validation system in accordance with one embodiment of the invention is designated generally by reference numeral 10. The coin validation system 10 has a passageway 12 with an entrance slot 14 through which coins pass, in use, and which opens into a coin receptacle 16. The system 10 further has two oscillators 18 and 20, each with a coil 18.1 and 20.1, the coils 18.1 and 20.1 surrounding the passageway 12. A period determining unit 22.1 and an amplitude determining unit 24.1 are provided for the first oscillator 18 and a period determining unit 22.2 and an amplitude determining unit 24.2 are provided for the second oscillator 20. These units determine the period and amplitude, respectively, of the oscillating signal supplied by the oscillators when a coin passes through their respective coils 18.1 and 20.1.

The system 10 further has an assessing unit 25 for assessing if the determined period and amplitude values supplied by the period and amplitude determining units 22.1, 24.1 lie in a predetermined window of period and amplitude values, which is an angled window in preferred embodiments. The assessing unit 25 supplies a response unit 26 with an appropriate signal, depending on the application. Thus, if the validation system is being used with a parking meter, the response unit 26 is a timer and the assessing unit 25 supplies it with a signal representative of the value of the coin that has been validated. The assessing unit 25 has a computing device 28 and a comparator 30.

The coils 18.1, 20.1 are positioned relative to the passageway 12 such that the frequency and the amplitude of oscillation of the oscillators 18, 20 are varied, in use, by passage of a coin (not depicted) along the passageway 12.

In the specific instance of the coin-operated machine being a parking meter, in use, in one embodiment, a coin entering the passageway 12 will fall under gravity into the receptacle 16. The arrangement of the coils 18.1, 20.1 is such that they do not interfere with one another in order to obtain two independent measurements of each coin that passes through the passageway 12. This is discussed in greater detail below.

In one embodiment, "upper coil", in this description, refers to the coil 18.1 that is closest in proximity to the coin slot 14 while, correspondingly, "lower coil" means the coil 20.1 that is furthest in proximity to the coin slot 14. Upper coil 18.1 forms part of the oscillator 18 and the lower coil 20.1 forms part of the oscillator 20. In one implementation, the oscillators 18, 20 are Colpitts oscillators; however, it is understood that other suitable oscillators may be used.

The first step in one embodiment of the method occurs on a coin being passed through the coin slot 14 of the machine. As the coin travels along the coin pathway 12, it passes through the upper coil 18.1. The magnetic properties of the coin cause a change in the frequency and amplitude of the oscillator 18 and the period and amplitude are measured by the period and amplitude determining units 22.1 and 24.1 respectively.

The determined period of oscillation and amplitude of oscillation are then assessed, by means of the assessing unit 25 to see if they lie in a predetermined angled window of period and amplitude values. The computing device 28 and comparator 30 will normally include a processor which is suitably programmed.

In one embodiment of the invention, the question of whether the determined period and amplitude values lie in the predetermined angled window of period and amplitude values is assessed by computing test period and amplitude values from the determined period and amplitude values utilising linear and rotational transformations, and comparing the resulting test amplitude value with a predetermined amplitude validation value and the test period value with a predetermined period validation value. In one embodiment, the assessing unit 25 thus includes the computing device 28 for computing the test period and amplitude values from the determined period and amplitude values utilising linear and rotational transformations, and the comparator 30 for comparing the test period and amplitude values with predetermined period and amplitude validation values, respectively. In one embodiment, the computing device uses predetermined multiplying and addition coefficients, which include the cosine and sine values of the angle (θ) defined by a straight line aligned with the window, its intersection value with the ordinate axis, and a representative abscissa value.

An example of the method of validating a coin according to several embodiments of the invention is now described algebraically:

First, as will be appreciated by those skilled in the art, reliance is placed on the well-established rotation transformation matrix:

$$R_\theta\begin{pmatrix} x \\ y \end{pmatrix} = \begin{pmatrix} \cos\theta & -\sin\theta \\ \sin\theta & \cos\theta \end{pmatrix}\begin{pmatrix} x \\ y \end{pmatrix} \tag{i}$$

and the linear transformation matrices:

$$\begin{pmatrix} x' \\ y' \end{pmatrix} = \begin{pmatrix} 1 & m \\ 0 & 1 \end{pmatrix}\begin{pmatrix} x \\ y \end{pmatrix} \tag{ii}$$

and $$\begin{pmatrix} x'' \\ y'' \end{pmatrix} = \begin{pmatrix} 1 & 0 \\ k & 1 \end{pmatrix}\begin{pmatrix} x \\ y \end{pmatrix} \tag{iii}$$

where matrix (ii) describes a linear transformation parallel to the y-axis, and matrix (iii) describes a linear transformation parallel to the x-axis respectively, and where constants m and k represent the magnitude of those respective transformations in the Cartesian plane.

Figure 2:
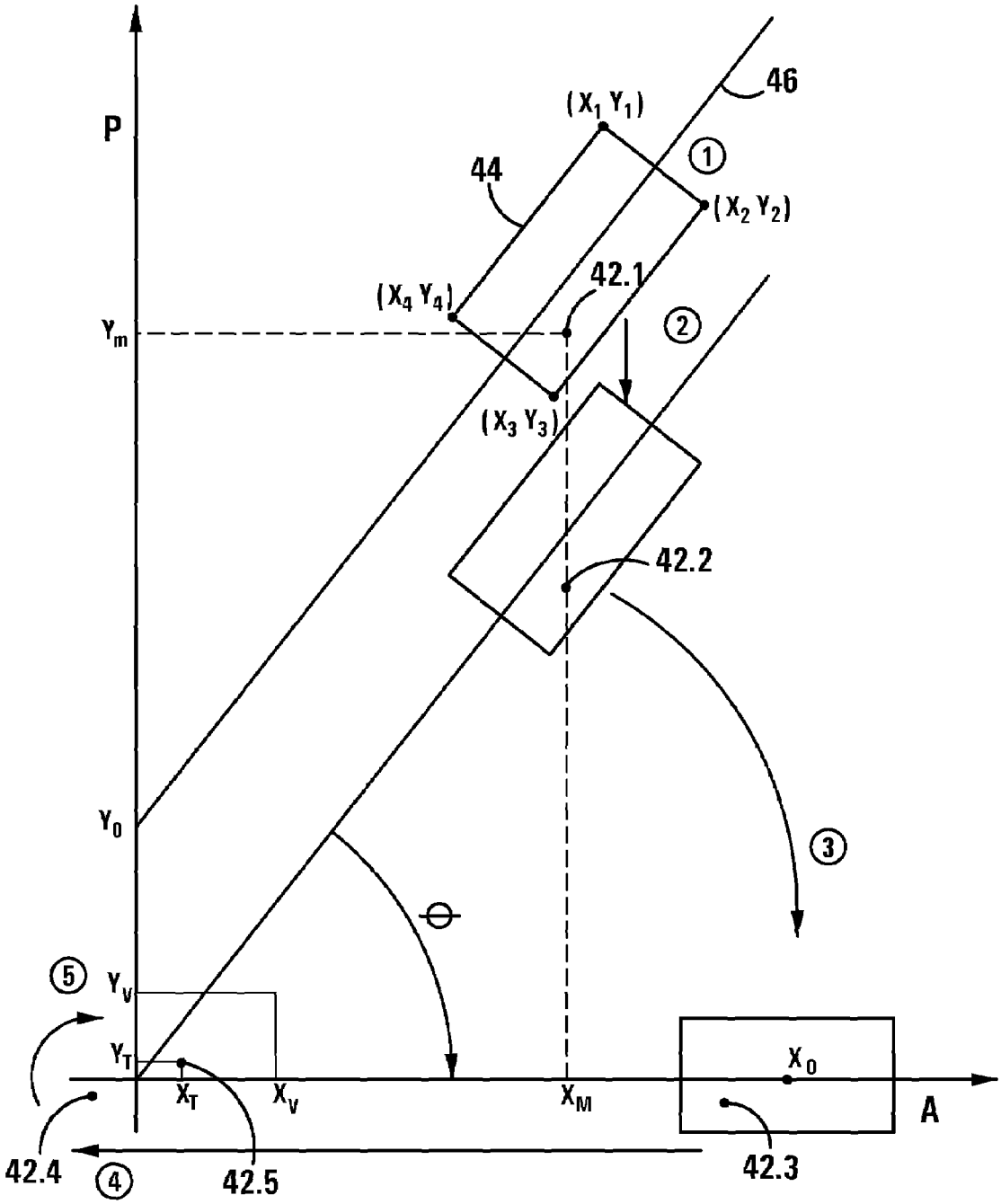
FIG. 2 is one embodiment of a graphic representation of the operations performed in assessing if the determined period and amplitude values lie in the predetermined angled window of period and amplitude values and calibration of coin-operated machines, so as to enable exercise of the method of several embodiments of the present invention.

The application of matrices (i)-(iii) will be appreciated from the description below with reference to FIG. 2.

The amplitude and period of oscillation, as measured by the amplitude and period determining units 24.1 and 22.1 respectively, may be regarded as a pair of Cartesian coordinates ($X_M$; $Y_M$) on a plot of period against amplitude. In one implementation, that set of coordinates is subjected to a linear transformation, of the type described in matrix (ii), a rotational transformation of the type described in matrix (i) and a further linear transformation of the type described in matrix (iii).

Thus, the determined amplitude of oscillation is multiplied by a first (cosine) coefficient; the predetermined period of oscillation less the period offset is multiplied by a second (sine) coefficient and added to the product of the determined amplitude and first coefficient and an amplitude offset (being the representative abscissa value) is subtracted therefrom, in order to obtain the test amplitude value. Similarly, the determined amplitude of oscillation is multiplied by the second coefficient; the determined period of oscillation less the period offset is multiplied by the first coefficient; and the product of the second coefficient and the amplitude of oscillation is subtracted therefrom in order to obtain the test period value. Stated algebraically:

$$X_T = |A.X_M + B(Y_M - Y_0) - X_0| \tag{iv}$$

$$Y_T = |A.(Y_M - Y_0) - B.X_M| \tag{v}$$

where:

| Symbol | Represents |
|---|---|
| $X_M$ | measured amplitude value |
| $Y_M$ | measured period value |
| $X_0$ | amplitude offset |
| $Y_0$ | period offset |
| A | cosine rotation coefficient |
| B | sine rotation coefficient |
| $X_T$ | test amplitude value |
| $Y_T$ | test period value |

This method of calculating these test values ($X_{T1}$; $Y_{T1}$), using the readings obtained at the upper coil 18.1, is then repeated in the same fashion using corresponding readings taken at the lower coil 20.1, in order to obtain test values ($X_{T2}$; $Y_{T2}$).

The manner in which the assessment is performed according to one embodiment is further described with reference to FIG. 2 which shows a plot of period against amplitude, and depicts, in stepwise fashion, the various transformations.

More specifically, the step marked as ①, shows a graphical representation of the measured pair of co-ordinates ($X_M$, $Y_M$) 42.1, which is obtained directly from the measurements of the period and amplitude determining units 22.1 and 24.1, described above. The assessment is to determine if the measured values ($X_M$, $Y_M$) lie within a predetermined angled window 44 defined by the co-ordinates ($X_1$, $Y_1$), ($X_2$, $Y_2$), ($X_3$, $Y_3$), and (X4, $Y_4$). It is to be noted that the window 44 defines a straight line 46 which bisects the window 44, defines angle ⊖ with the X-axis and intersects the Y-axis at $Y_0$.

In step ②, a linear transformation of the type described by matrix (ii) is performed, in order to remove the y-offset $Y_0$, producing coordinate pair 42.2. In step ③ a rotational transformation is performed, utilising matrix (i) to produce co-ordinate pair 42.3, whereafter a further linear transformation, of the type described by matrix (iii) is performed to remove an x-offset $X_0$. It will be noted that $X_0$ is defined by the centre point of the window 44. This linear transformation provides co-ordinate pair 42.4. The absolute value is taken of both the abscissa and ordinate of co-ordinate pair 42.4, as is depicted graphically in step ⑤, to yield co-ordinate pair 42.5, which is the values $X_T$ and $Y_T$.

The final stage of the assessment process is to compare the values of $X_T$ and $Y_T$ with the values of $X_V$ and $Y_V$, which correspond with $X_1$ and $Y_1$, respectively.

It will be appreciated that in several embodiments, there will be a different window 44 for each denomination of coin. One embodiment of the manner in which the system 10 is calibrated, and the boundaries of the window 44 for each denomination determined is now described. The coefficients and the validation values are determined by calibrating a suitable number of coins or slugs of each denomination. It has been found that, typically, 100 coins or slugs of each denomination is suitable for this purpose, although it has been found by the inventors that using 30 coins or more of the same denomination in the calibration process is sufficient to achieve reliable calibration. Thus, the amplitude and period values measured for each test coin or slug are plotted graphically and the line 46 obtained by a "best fit" process. This then provides a value for $Y_0$ and ⊖. The linear and rotational transformation are performed on the centre value of the window 44 to provide $X_0$. The values of $X_V$ and $Y_V$ are determined in one of several ways. In a preferred way, the measurements for all test coins are processed as described above to obtain the transformed values thereof. An average value is obtained for the abscissa and the ordinate of each transformed co-ordinate pair. The average abscissa value is then multiplied by a predetermined factor to provide $X_V$ and, similarly, the average ordinate value is multiplied by another predetermined factor to provide $Y_V$. Another way involves determining the maximum deviation of both the abscissa and the ordinate values of the calculated transformed co-ordinates, and multiplying the maximum abscissa deviation by a predetermined factor to yield $X_V$ and, similarly, multiplying the maximum ordinate deviation by another predetermined factor to yield $Y_V$. This method has been found to be less desirable, however, since a greater number of coins or slugs is required to be used in the calibration process (relative to the quantity of coins or slugs required for the first method), in order to obtain a reliable calibration. In a third way, the window 44 is defined graphically to incorporate all the measured test values and the transformations performed on the co-ordinates $X_1$, $Y_1$.

It is noted that different coins of the same denomination will produce substantially similar results when the above operations are performed, and it is this range of results that forms the calibrated range of results for each denomination (this is referred to in the trade as the "coin window").

An identical calibration process is performed for each type of coin in monetary circulation, and a corresponding angled window for each denomination of coin is obtained. Significantly, owing to the different metallic constituents and size of each coin in circulation, each type of coin will exert a different influence on the oscillating signal of the oscillators 18, 20, with the result that each coin window will include a unique range of results.

Typical calibration figures that have been obtained in experimental trials conducted are summarised in Table 1 below:

TABLE 1

Calibration Figures Obtained Utilising 100 Different Coins Of Each Coin In US Monetary Circulation

| | | Upper oscillator | | | | | Lower oscillator | | | | |
|---|---|---|---|---|---|---|---|---|---|---|---|
| | Coins (USA) | $Y_0$ | Theta (deg) | $X_0$ | $X_V$ | $Y_V$ | $Y_0$ | Theta (deg) | $X_0$ | $X_V$ | $Y_V$ |
| Window 00 | 1 c old | −177 | 61 | 458 | 162 | 24 | −47 | 56 | 392 | 100 | 25 |
| Window 01 | 1 c new | −243 | 57 | 497 | 178 | 28 | −108 | 53 | 466 | 148 | 29 |
| Window 02 | 5 c | −125 | 39 | 339 | 160 | 42 | −293 | 42 | 838 | 165 | 45 |
| Window 03 | 10 c | −149 | 60 | 305 | 151 | 25 | −125 | 59 | 321 | 123 | 23 |
| Window 04 | 25 c | −278 | 66 | 605 | 200 | 24 | −166 | 58 | 552 | 190 | 29 |

The amplitude offset value, period offset value, first coefficient value (in the form of the cosine rotation coefficient), second coefficient (in the form of the sine rotation coefficient), amplitude validation value and period validation value are predetermined for each coin denomination. It will then be appreciated that a particular coin is validated and is allocated the value of a particular denomination, if the test period and amplitude values computed for the coin are between zero and the validation amplitude and period values for that denomination.

From trial experiments of one embodiment of the invention that have been run, it has been determined that validation calculations using all five of a set of five angled windows can be performed in approximately 500 μs. This means that there is no significant delay in the amount of time required to take readings at both the upper coil 18.1 and lower coil 20.1, and also to conduct the full iterative validation process.

In preferred form, if it should happen that, after following iterative process, the coordinates $[(X_{T1}+X_{T2}); (Y_{T1}+Y_{T2})]$ are found not to appear in the range of any one of the angled windows, then the coin is not validated, and the coin is not accepted.

Specifically, in a preferred embodiment of the invention, the computer program (for example, as implemented by the assessing unit 25) is programmed with the condition that, if one of $[(X_{T1}; Y_{T1}), (X_{T2}; Y_{T2})]$ appears in the range of any one of the angled windows, but that the other does not, then the coin is validated. It is also envisaged, in an alternative embodiment, that the computer program will be programmed with the condition that the coin will be validated only if both of $(X_{T1}; Y_{T1})$ and $(X_{T2}; Y_{T2})$ fall within the range of the same angled window.

Also in a preferred embodiment of the invention, the computer program is further programmed with the condition that, if any one of the set of calculated fit-values $\{X_{T1}; X_{T2}; Y_{T1}; Y_{T2}\}=0$ then validation of the coin is automatically refused without the need to proceed further.

Once a coin has been validated, a final operation is conducted, and that is to allocate to the coin the denomination value that is associated uniquely with the relevant angled window. This allocation is reflected as a credit in the coin-operated machine. It follows that coins which are not validated are assigned a value of 0, or are not assigned any value at all.

As indicated above, instead of using the period of oscillation, the frequency may be used, in a similar manner.

It will be further appreciated by the person skilled in the art that application of embodiments of this invention are not limited to parking meters only, but that embodiments of this invention also have application to a multitude of coin-operated machines, including parking lot pay-point machines, vending machines, jukeboxes and laundromat washing machines.

What is claimed is:

1. A system for validating a coin, the system including:

a passageway through which the coin passes;

an oscillator having a component positioned relative to the passageway for the frequency and amplitude of oscillation of the oscillator to be varied, by passage of the coin along the passageway;

a time feature determining unit for determining a time feature of an oscillating signal provided by the oscillator when influenced by the coin and for supplying a determined time feature value;

an amplitude determining unit for determining the amplitude of the oscillating signal provided by the oscillator when influenced by the coin and for supplying a determined amplitude value; and an assessing unit for assessing if the determined time feature and amplitude values lie in a predetermined window of time feature and amplitude values;

in which the predetermined window of time feature and amplitude values is defined by straight lines;

in which the straight lines define a rectangle; and in which the predetermined window is angled with respect to a set of time feature and amplitude axes.

2. A system for validating a coin, the system including a passageway through which the coin passes;

an oscillator having a component positioned relative to the passageway for the frequency and amplitude of oscillation of the oscillator to be varied, by passage of the coin along the passageway;

a time feature determining unit for determining a time feature of an oscillating signal provided by the oscillator when influenced by the coin and for supplying a determined time feature value;

an amplitude determining unit for determining the amplitude of the oscillating signal provided by the oscillator when influenced by the coin and for supplying a determined amplitude value; and an assessing unit for assessing if the determined time feature and amplitude values lie in a predetermined window of time feature and amplitude values;

in which the assessing unit includes a computing device for computing test time feature and amplitude values from the determined time feature and amplitude values and a comparator for comparing the test time feature and amplitude values with predetermined time feature and amplitude validation values; and in which the computing device performs, a rotational transformation to provide the test time feature and amplitude values.

3. A system for validating a coin as claimed in claim 2, in which the computing device performs, a linear transformation to provide the test time feature and amplitude values.

4. A system for validating a coin as claimed in claim 2, in which the computing device uses predetermined multiplying and addition coefficients.

5. A system for validating a coin as claimed in claim 2, in which the comparator compares, the test time feature and amplitude values with a plurality of time feature and amplitude validation values for a plurality of coin denominations.

6. A system for validating a coin as claimed in claim 2, in which the said oscillator component is a coil, which surrounds the passageway.

7. A system for validating a coin as claimed in claim 2, which has a plurality of oscillators with each oscillator having a component positioned relative to the passageway for the frequency and amplitude of each oscillator to be varied, by passage of a coin along the passageway and a plurality of time feature determining units and amplitude determining units, each oscillator being associated with a time feature determining unit and an amplitude determining unit and in which the assessing unit assesses if the determined time feature and amplitude values lie in the predetermined window.

8. A system for validating a coin as claimed in claim 2, in which the time feature is the period of oscillation of the oscillating signal.

9. A parking meter which includes a system as claimed in claim 2.

10. A system for validating a coin as claimed in claim 2, in which the time feature is a change in the frequency of the oscillating signal when influenced by the coin.

11. A system for validating a coin as claimed in claim 7, in which a first oscillator of the plurality of oscillators is associated with a first set of determined time feature and amplitude values, and a second oscillator of the plurality of oscillators is associated with a second set of determined time feature and amplitude values, and the assessing unit assesses if the first set of determined time feature and amplitude values lie in a first predetermined window of time feature and amplitude values and assesses if the second set of determined time feature and amplitude values lie in a second predetermined window of time feature and amplitude values, wherein the first and second predetermined windows comprise coordinates that are different.

12. A system for validating a coin as claimed in claim 11, in which the assessing unit validates the coin upon assessing that both the first set of determined time feature and amplitude values lie in the first predetermined window and the second set of determined time feature and amplitude values lie in the second predetermined window.

13. A system for validating a coin as claimed in claim 11, in which the assessing unit validates the coin upon assessing that the first set of determined time feature and amplitude values lie in the first predetermined window or upon assessing that the second set of determined time feature and amplitude values lie in the second predetermined window.

14. A method of validating a coin in a coin-operated machine having a coin passageway, the method including the steps of:

providing an oscillator, having a component positioned relative to the passageway for the frequency and amplitude of oscillation of the oscillator to be varied, by passage of the coin along the passageway;

determining a time feature of oscillation of an oscillating signal provided by the oscillator when a coin to be validated influences the oscillator;

determining the amplitude of the oscillating signal; and assessing if the determined time feature and amplitude values lie in a predetermined window of time feature and amplitude values;

in which the predetermined window of time feature and amplitude values is defined by straight lines;

in which the straight lines define a rectangle; and in which the predetermined window is angle with respect to a set of time feature and amplitude axes.

15. A method of validating a coin in a coin-operated machine having a coin passageway, the method including the steps of:

providing an oscillator, having a component positioned relative to the passageway for the frequency and amplitude of oscillation of the oscillator to be varied, by passage of the coin along the passageway;

determining a time feature of oscillation of an oscillating signal provided by the oscillator when a coin to be validated influences the oscillator;

determining the amplitude of the oscillating signal; and assessing if the determined time feature and amplitude values lie in a predetermined window of time feature and amplitude values;

which includes computing test time feature and amplitude values from the determined time feature and amplitude values and comparing the test time feature and amplitude values with predetermined time feature and amplitude validation values; and which includes performing a rotational transformation to provide the test time feature and amplitude values.

16. A method as claimed in claim 15, which includes performing a linear transformation to provide the test time feature and amplitude values.

17. A method as claimed in claim 15, in which predetermined multiplying and addition coefficients are used.

18. A method as claimed in claim 15, in which the test time feature and amplitude values are compared with predetermined time feature and amplitude validation values for a plurality of coin denominations.

19. A method as claimed in claim 15, in which the component is a coil.

20. A method as claimed in claim 15, in which a plurality of oscillators is provided with each oscillator having a component positioned relative to the passageway for the frequency and amplitude of each oscillator to be varied, in use, by passage of a coin along the passageway and in which the time feature and amplitude of oscillation of the oscillating signal provided by each oscillator is determined and the determined time feature and amplitude values of each oscillator are assessed to ascertain if they lie in the predetermined window of time feature and amplitude values.

21. A method as claimed in claim 15, in which the time feature is the period of oscillation of the oscillating signal.

22. A method as claimed in claim 15, in which the coin-operated machine is a parking meter.

23. A method as claimed in claim 15, in which the time feature is a change in frequency of the oscillating signal influenced by the coin.

24. A method as claimed in claim 20, in which a first oscillator of the plurality of oscillators is associated with a first set of determined time feature and amplitude values, and a second oscillator of the plurality of oscillators is associated with a second set of determined time feature and amplitude values, and wherein assessing comprises assessing if the first set of determined time feature and amplitude values lie in the first predetermined window and assessing if the second set of determined time feature and amplitude values lie in the second predetermined window, wherein the first and second predetermined windows comprise coordinates that are different.

25. A method as claimed in claim 24, further comprising validating the coin upon assessing that both the first set of determined time feature and amplitude values lie in the first predetermined window and the second set of determined time feature and amplitude values lie in the second predetermined window.

26. A method as claimed in claim 24, further comprising validating the coin upon assessing that the first set of determined time feature and amplitude values lie in the first predetermined window or upon assessing that the second set of determined time feature and amplitude values lie in the second predetermined window.

27. A method as claimed in claim 15, further comprising:

measuring a plurality of time feature and amplitude values for a plurality of coins; and performing a best-fit process on the plurality of measured time feature and amplitude values to determine an angle of the rotational transformation.

28. A method as claimed in claim 27, further comprising determining the predetermined window of time feature and amplitude values based on the plurality of measured time feature and amplitude values for the plurality of coins.

* * * * *